US009488437B1

(12) United States Patent
Schnog

(10) Patent No.: US 9,488,437 B1
(45) Date of Patent: Nov. 8, 2016

(54) FIREARM MOUNTED VIDEO CAMERA SYSTEM

(71) Applicant: Gideon Schnog, Miami, FL (US)

(72) Inventor: Gideon Schnog, Miami, FL (US)

( * ) Notice: Subject to any disclaimer, the term of this patent is extended or adjusted under 35 U.S.C. 154(b) by 201 days.

(21) Appl. No.: 14/268,578

(22) Filed: May 2, 2014

(51) Int. Cl.
*H04N 7/18* (2006.01)
*F41C 27/00* (2006.01)

(52) U.S. Cl.
CPC ..... *F41C 27/00* (2013.01)

(58) Field of Classification Search
CPC ..... F41C 27/00
See application file for complete search history.

(56) References Cited

U.S. PATENT DOCUMENTS

| | | | | |
|---|---|---|---|---|
| 1,360,443 | A | 11/1920 | Robertson et al. | |
| 1,955,300 | A | 4/1934 | Kurnick | |
| 2,005,366 | A | 6/1935 | Gaty | |
| 2,144,909 | A | 1/1939 | Atkin et al. | |
| 2,282,680 | A | 5/1942 | Sonne | |
| 2,500,379 | A | 3/1950 | Sonne | |
| 2,719,469 | A | 10/1955 | Sanford | |
| 3,545,356 | A | 12/1970 | Nielsen | |
| 3,688,665 | A | 9/1972 | Herden | |
| 4,309,095 | A | 1/1982 | Buckley | |
| 4,835,621 | A | 5/1989 | Black | |
| 4,907,022 | A | 3/1990 | Myers | |
| 4,989,024 | A | 1/1991 | Myers | |
| 5,020,262 | A | 6/1991 | Pena | |
| 5,347,740 | A | 9/1994 | Rather et al. | |
| 5,887,375 | A | 3/1999 | Watson | |
| 6,000,163 | A | 12/1999 | Gordon | |
| 7,146,200 | B2 | 12/2006 | Park et al. | |
| 7,188,978 | B2 | 3/2007 | Sharrah et al. | |
| 9,097,479 | B1 * | 8/2015 | Barido | F41A 17/54 |
| 2005/0099498 | A1 * | 5/2005 | Lao | H04N 5/765 348/207.99 |
| 2007/0234628 | A1 * | 10/2007 | La France | F41G 11/003 42/146 |
| 2009/0044439 | A1 * | 2/2009 | Phillips | F41C 23/14 42/72 |
| 2010/0026845 | A1 * | 2/2010 | Kang | H04N 1/2145 348/231.2 |
| 2011/0010979 | A1 * | 1/2011 | Houde-Walter | F41C 23/22 42/84 |
| 2011/0035984 | A1 * | 2/2011 | Liu | F41C 27/00 42/111 |
| 2011/0061283 | A1 * | 3/2011 | Cavallo | F41G 11/003 42/72 |
| 2011/0275435 | A1 * | 11/2011 | Torre | A63F 13/02 463/37 |
| 2015/0198406 | A1 * | 7/2015 | Ling | F41G 11/003 42/90 |

* cited by examiner

*Primary Examiner* — Tat Chio
(74) *Attorney, Agent, or Firm* — Albert Bordas, P.A.

(57) ABSTRACT

A firearm mounted video camera system that is intended for civilians, law enforcement, and military professionals to generate tangible evidence for examination of firearm shooting related incidents. A mounting frame has a pressure switch grip assembly, a trigger guard cover assembly, a trigger guard side plate assembly, and an audio-visual rail. In addition, the firearm mounted video camera system has an audio-visual recording assembly. The audio-visual recording assembly mounts onto the audio-visual rail. The audio-visual recording assembly has recording means to record audio and/or video recordings of a target and/or surrounding area when a pressure switch of the pressure switch grip assembly is activated. The pressure switch grip assembly comprises a bottom edge, a top end, an exterior face, and an interior face. A pressure switch is cooperatively mounted within the pressure switch grip assembly. The pressure switch grip assembly mounts onto a grip of a firearm.

8 Claims, 7 Drawing Sheets

FIREARM MOUNTED VIDEO CAMERA SYSTEM

BACKGROUND OF THE INVENTION

1. Field of the Invention

The present invention relates to firearm accessories, and more particularly, to firearm mounted video camera systems.

2. Description of the Related Art

Applicant believes that one of the closest references corresponds to U.S. Pat. No. 1,360,443 B1 issued to Robertson et al. on Nov. 30, 1920 for Gun Camera. However, it differs from the present invention because Robertson et al. teaches an apparatus combined with a mechanism of a machine gun for the purpose of training machine guns operators by photographically recording their aim during practice fire.

Applicant believes that another reference corresponds U.S. Pat. No. 1,955,300 B1 issued to Kurnick on Apr. 17, 1934 for Camera Gun. However, it differs from the present invention because Kurnick teaches a camera gun having a photographic attachment connected with a trigger of a gun to allow for simultaneous discharge of the gun and activation of a camera to take a photograph of a target.

Applicant believes that another reference corresponds to U.S. Pat. No. 2,005,366 B1 issued to Gaty on Jun. 18, 1935 for Machine Gun Camera. However, it differs from the present invention because Gaty teaches photographic cameras that simulate the form of a machine gun. Specifically, manipulation accuracy of the machine gun can be examined by the inspection of pictures taken.

Applicant believes that another reference corresponds to U.S. Pat. No. 2,144,909 B1 issued to Atkin et al. on Jan. 24, 1939 for Combination Gun and Camera. However, it differs from the present invention because Atkin et al. teaches firearms having incorporated therein a camera for the purpose of photographing objects at which the firearms aim.

Applicant believes that another reference corresponds to U.S. Pat. No. 2,282,680 B1 issued to Sonne on May 12, 1942 for Gun Camera. However, it differs from the present invention because Sonne teaches gun cameras and specifically a camera that is affixed to a gun to photographically record its aim at the moment of discharge.

Applicant believes that another reference corresponds to U.S. Pat. No. 2,500,379 B1 issued to Sonne on Mar. 14, 1950 for Gun Camera Mount. However, it differs from the present invention because Sonne teaches shock absorbing camera mounts, especially for military aircraft.

Applicant believes that another reference corresponds to U.S. Pat. No. 2,719,469 B1 issued to Sanford on Oct. 4, 1955 for Camera Flash Gun Attachment. However, it differs from the present invention because Sanford teaches a camera flash-gun attachment and details a type of bracketing.

Applicant believes that another reference corresponds to U.S. Pat. No. 3,545,356 B1 issued to Nielsen on Dec. 8, 1970 for Camera Telescope Apparatus for Guns. However, it differs from the present invention because Nielsen teaches a camera-telescope in combination with a gun, whereby the camera is arranged to photograph the image of the telescope.

Applicant believes that another reference corresponds to U.S. Pat. No. 3,688,665 B1 issued to Herden on Sep. 5, 1972 for Camera in Gun Form. However, it differs from the present invention because Herden teaches an in-line telescopic objective and viewer that serves as a trigger-operated mirror for the capturing of photographs to provide for long-range photography in a gun.

Applicant believes that another reference corresponds to U.S. Pat. No. 4,309,095 B1 issued to Buckley on Jan. 5, 1982 for Camera Mounting Device. However, it differs from the present invention because Buckley teaches a camera mounting device for mounting a camera to a hunting rifle, comprising a first mounting bracket adapted to support a camera, a threaded fastener to detachably secure a camera to the first mounting bracket, a variable diameter clamp to clamp the first mounting bracket to the barrel of the telescope sight of a rifle, a cable release for remote actuation of the camera, a second mounting bracket connected to the cable release, and threaded fasteners for detachably securing the second mounting bracket to the trigger guard of a rifle so that actuation of the cable release is coordinated to actuation of the rifle trigger.

Applicant believes that another reference corresponds to U.S. Pat. No. 4,835,621 B1 issued to Black on May 30, 1989 for Gun Mounted Video Camera. However, it differs from the present invention because Black teaches a video camera recording device having a gunstock and a support structure for which includes a mounting platform adapted to receive thereon a hand held video camera recorder having a lense structure defining a line of sight, a recording medium for recording video information, and a viewfinder and mounting structure for mounting the viewfinder onto the gunstock. Structure is provided for effecting a sequential activating and deactivating of the video camera recording device for the purpose of starting a recording of video information onto the recording medium and stopping the recording, respectively. A gun sight is located in the line of sight so as to be visible through the viewfinder when the video camera recorder is recording video information on the recording medium. A trigger is provided on the gunstock and is adapted to be manually activated by a finger of a user's hand. A signal generator is provided which generates a signal visible through the viewfinder in response to the user activating the trigger. The signal is also simultaneously recorded on the recording medium.

Applicant believes that another reference corresponds to U.S. Pat. No. 4,907,022 B1 issued to Myers on Mar. 6, 1990 for Photographic Gun. However, it differs from the present invention because Myers teaches a hand held weapon simulating a rifle, shotgun or pistol having a camera pivotally mounted in the area of the usual projectile insertion and ejecting mechanism which has its shutter, focus and f adjustment means mounted in or adjacent the firing chamber which camera is actuated by trigger action of the weapon for taking pictures through the barrel of the weapon.

Applicant believes that another reference corresponds to U.S. Pat. No. 4,989,024 B1 issued to Myers on Jan. 29, 1991 for Photographic Gun. However, it differs from the present invention because Myers teaches a hand held weapon simulating a rifle, shotgun or pistol having a camera mounted in the area of the usual projectile insertion and ejecting mechanism which has its shutter, focus and f adjustment means mounted in or adjacent the firing chamber which camera is actuated by trigger action of the weapon for taking pictures through the barrel of the weapon. A cover is pivotally mounted on either the camera or frame of the weapon for exposing the film for camera loading and unloading purposes.

Applicant believes that another reference corresponds to U.S. Pat. No. 5,020,262 B1 issued to Pena on Jun. 4, 1991 for Camera Mount For Rifle Scopes. However, it differs from the present invention because Pena teaches an apparatus that includes a mount for use on a telescope in combination with a rifle. The mount is clamped onto the telescope, and has a camera attached to the top of the mount. A cable mechanism is attached at one end to the shutter release of the camera and at the other end to the trigger of the rifle. The camera is arranged to photograph the image received through the telescope and reflected through the mount. The cable mechanism provides means for controlling the operation of the camera. A housing is clamped onto the telescope and has an eyepiece, which fits onto the eyepiece of the telescope and contains a split prism, which is positioned in the eyepiece at an angle such that it can be seen through for viewing the image of the target received through the telescope. The split prism has a reflective surface on one side, which reflects the image of the target upwardly to a first surface mirror positioned in the housing above the split prism at an angle such that it receives the image reflected from the split prism, and then reflects the image forwardly to a second surface mirror. A second surface mirror is positioned at the forward end of the housing and at an angle that it receives the image reflected from the first surface mirror, and then reflects the image upwardly to the camera lens. The image of the target is photographed when the trigger of the rifle is pulled.

Applicant believes that another reference corresponds to U.S. Pat. No. 5,347,740 B1 issued to Rather et al. on Sep. 20, 1994 for Multi-Functional Variable Position Rifle and Camera Mount. However, it differs from the present invention because Rather et al. teaches a combination of a camera mount and a gun mount allowing horizontal, vertical and positional adjustment with manually activated locking knobs allowing multidirectional shooting with a gun that may be rigidly clamped in any one of a multiplicity of rapidly adjustable positions and with the camera adjustably mounted allowing a hunter to take a picture instead using the gun.

Applicant believes that another reference corresponds to U.S. Pat. No. 5,887,375 B1 issued to Watson on Mar. 30, 1999 for Camera Mount For Firearms. However, it differs from the present invention because Watson teaches a camera mount for firearms, comprising a base plate; an intermediate plate operatively attached to the base plate; a dampening material, operatively attached between the base plate and the intermediate plate, for dampening recoil forces transmitted to the intermediate plate; and a mounting plate removably attached to the intermediate plate, the mounting plate includes a camera attachment device for allowing attachment of a camera to the mounting plate; and an adjustment mechanism, operatively connected between the intermediate plate and the mounting plate, for allowing the camera to be aligned with respect to the firearm. The camera mount further includes a firearm-mounting device, operatively attached to the base plate, for mounting the camera mount to the firearm. In one embodiment, the firearm-mounting device includes at least one scope mounting bracket shaped and dimensioned to allow attachment of the camera mount to a scope on the firearm. In an alternate embodiment, the firearm-mounting device includes a forestock mounting bracket shaped and dimensioned to allow attachment of the camera mount to the forestock on the firearm.

Applicant believes that another reference corresponds to U.S. Pat. No. 7,146,200 B2 issued to Park et al. on Dec. 5, 2006 for Camera Lense Mounting Device of Folder Type Telephone. However, it differs from the present invention because Park et al. teaches a camera lens-mounting device of a folder-type telephone. The folder-type telephone includes a body housing, a folder, and hinge means for rotatably connecting the body housing to the folder. The camera lens-mounting device comprises hinge arms and a guide arm, which are integrally formed on a hinge axis of the body housing. A camera lens assembly is installed between the guide arm and one of the hinge arms so that a camera lens housing rotates within a designated angle, and the camera lens housing includes a camera lens assembly, a connector, and a rotating handle grip.

Applicant believes that another reference corresponds to U.S. Pat. No. 7,188,978 B2 issued to Sharrah et al. on Mar. 13, 2007 for Light Mountable on a Mounting Rail. However, it differs from the present invention because Sharrah et al. teaches a mounting arrangement for a light or other object that includes a clamping arrangement, or a keying arrangement, or both a clamping and a keying arrangement for mounting to different mounting rails having different keying features. The clamping arrangement includes a fixed clamp member and a movable clamp member that is movable towards and away from the fixed clamp member and is biased towards the fixed clamp member, so as to grip a mounting rail therebetween. The keying arrangement employs interchangeable keying members that may be disposed in a recess of the light or other object and that may have different keying features for use with mounting rails having corresponding keying features Applicant believes that another reference corresponds to U.S. Pat. No. 6,000,163 B1 issued to Gordon on Dec. 14, 1999 for Photographic Rifle Scope Apparatus and Method. However, it differs from the present invention because Gordon teaches a telescopic firearm scope/sight, which is fully integrated with a compact digital camera, and which has size, shape and weight characteristics that are substantially the same as those of a conventional, camera-less telescopic scope, is used to photograph a target proximate the instant at which the target is fired upon. To configure the weapon for photography and firing, the scope is simply placed on the firearm in the same manner as a conventional scope, and the firearm is then fired in the conventional manner. Photographs are recorded, alternatively, in response to the sound of, or the recoil from, the firearm firing.

Other patents describing the closest subject matter provide for a number of more or less complicated features that fail to solve the problem in an efficient and economical way. None of these patents suggest the novel features of the present invention.

SUMMARY OF THE INVENTION

The present invention is a video camera device for attachment to firearms that is intended for civilians, law enforcement, and military professionals to generate tangible evidence for examination of firearm shooting related incidents.

More specifically, the present invention is a firearm mounted video camera system, comprising a mounting frame having a pressure switch grip assembly, a trigger guard cover assembly, a trigger guard side plate assembly, and an audio-visual rail. The present invention also comprises an audio-visual recording assembly.

The audio-visual recording assembly mounts onto the audio-visual rail. The audio-visual recording assembly comprises recording means to record audio and/or video recordings of a target and/or surrounding area when a pressure switch of the pressure switch grip assembly is activated.

The pressure switch grip assembly comprises a bottom edge, a top end, an exterior face, and an interior face. A pressure switch is cooperatively mounted within the pressure switch grip assembly. The pressure switch is activated when a predetermined force is placed upon the exterior face. The pressure switch grip assembly mounts onto a grip of a firearm.

The trigger guard cover assembly and the trigger guard side plate assembly mount onto a trigger guard of a firearm.

The audio-visual rail is biased against an underside of a firearm frame. The audio-visual rail extends from the trigger guard cover assembly to a front edge, the audio-visual rail further comprises a rear wall having an electrical contact, and a top face. The audio-visual recording assembly comprises electronic connection means cooperatively disposed to contact the electrical contact. The electronic connection means serves to download data and/or content of audio and/or video recordings and to recharge at least one rechargeable battery. In an alternate embodiment, the audio-visual recording assembly comprises electronic connection means to enable wireless download of data and/or content of audio and/or video recordings and to wireless recharge at least one rechargeable battery.

The trigger guard side plate assembly is assembled onto the trigger guard cover assembly. The audio-visual recording assembly comprises a laser, and a rail.

The audio-visual recording assembly further comprises electronic memory capacity for recording, and data override capabilities so that most recent recordings are available. Furthermore, the audio-visual recording assembly comprises date and time stamp capabilities on recordings, and has quick detachment from said mounting frame while said pressure switch grip assembly, said trigger guard cover assembly, and said audio-visual rail remain on a firearm.

It is therefore one of the main objects of the present invention to provide a firearm mounted video camera system that generates tangible evidence for examination of firearm shooting related incidents.

It is another object of this invention to provide a firearm mounted video camera system that is removably mounted to a firearm.

It is another object of this invention to provide a firearm mounted video camera system comprising a mounting frame and an audio-visual recording assembly.

It is another object of this invention to provide a firearm mounted video camera system that is volumetrically efficient for carrying, transporting, and storage.

It is another object of this invention to provide a firearm mounted video camera system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
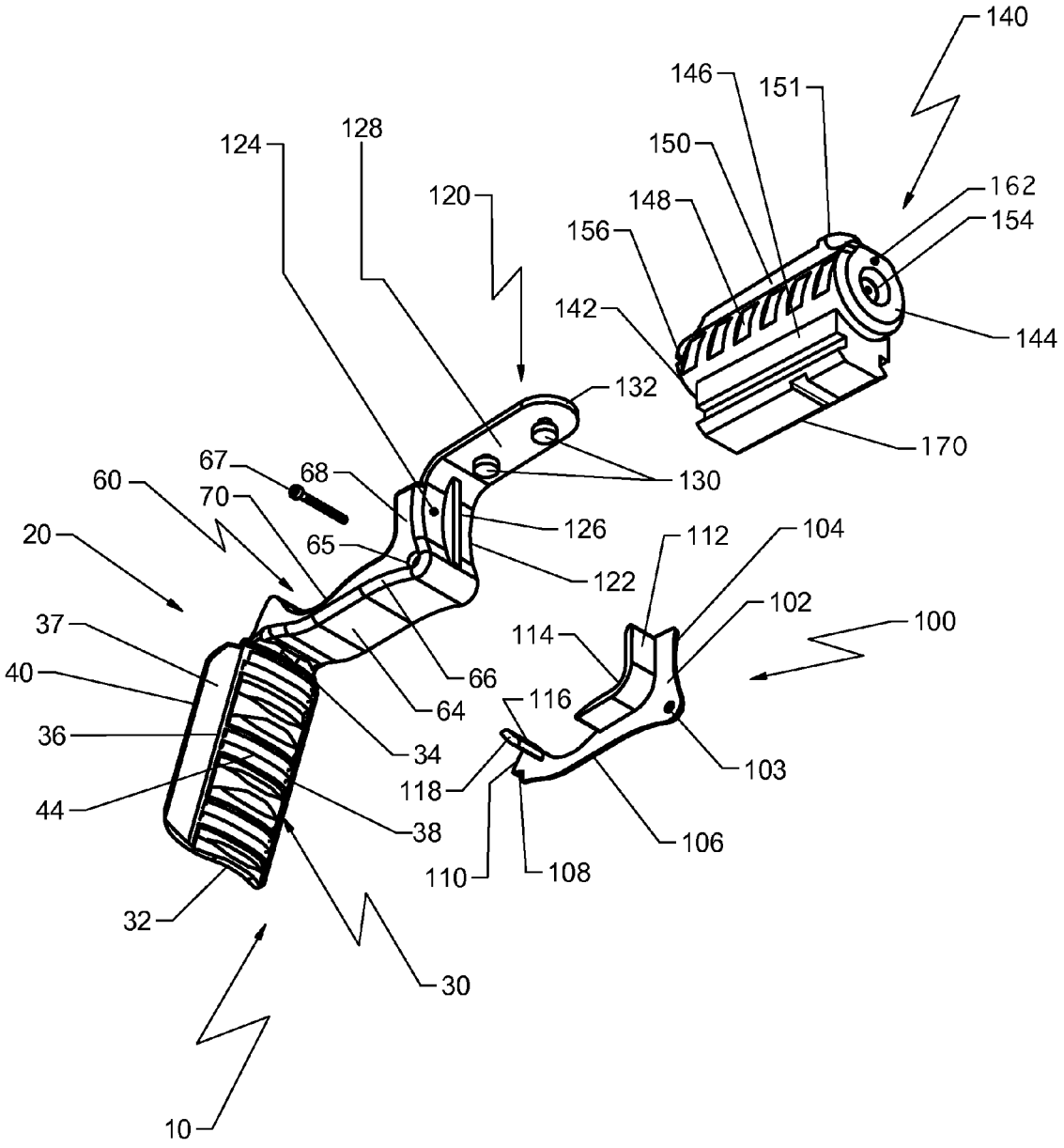
FIG. 1 is a front isometric exploded view of the present invention.

Referring now to the drawings, the present invention is a firearm mounted video camera system and is generally referred to with numeral 10. It can be observed that it basically includes mounting frame 20 and audio-visual recording assembly 140, whereby present invention 10 is removably mounted to firearm 200.

Figure 2:
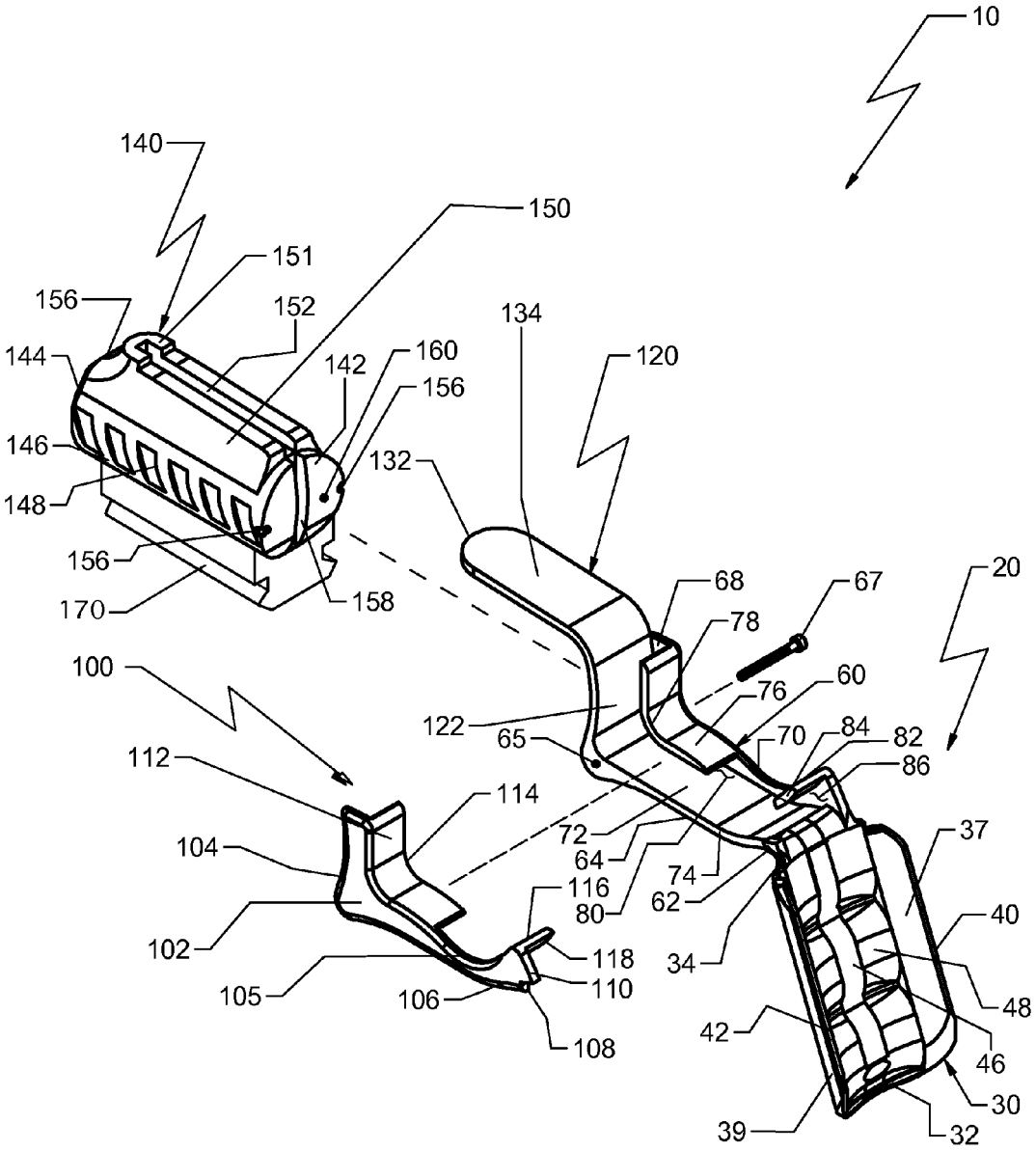
FIG. 2 is a rear isometric exploded view of the present invention seen in FIG. 1.

As seen in FIGS. 1 and 2, mounting frame 20 comprises pressure switch grip assembly 30, trigger guard cover assembly 60, trigger guard side plate assembly 100, and audio-visual rail 120. In a preferred embodiment, pressure switch grip assembly 30, trigger guard cover assembly 60, and audio-visual rail 120 are a single structure, while trigger guard side plate assembly 100 is independent and secured onto mounting frame 20 with screw 67.

Pressure switch grip assembly 30 comprises bottom edge 32, top end 34, exterior face 44, and interior face 48. Extending at a predetermined angle from lateral edges 36 and 38 are lateral walls 37 and 39, respectively. Lateral walls 37 and 39 have respective edges 40 and 42. As best seen in FIG. 2, pressure switch 46 is cooperatively mounted at interior face 48. Pressure switch 46 is activated when a predetermined force is placed upon exterior face 44.

Trigger guard cover assembly 60 comprises exterior face 64, interior face 72, lateral edge 66, and edge 74. Edge 74 has rear protrusion 62 adjacent to top end 34. Extending from lateral edge 66 is lateral wall 68 having edge 70. Forward trigger guard wall 76 extends from edge 70 and has a substantial L-shape. A first section of forward trigger guard wall 76 extends toward edge 74, without reaching edge 74, and a second section of forward trigger guard wall 76 defines cavity 80. Forward trigger guard wall 76 has edge 78. Rear trigger guard wall 82 has edge 84 and extends from edge 70 adjacent to top end 34. Rear trigger guard wall 82 extends toward edge 74 without reaching edge 74, thus defining cavity 86. Hole 65 extends transversally through trigger guard cover assembly 60 and audio-visual rail 120. Hole 65 receives screw 67 therethrough.

Audio-visual rail 120, having a substantial L-shape, extends from trigger guard cover assembly 60 to its front edge 132. As best seen in FIG. 1, rear wall 122 has electrical contact 124 and protrusion 126. Locking protrusions 130 extend from bottom face 128. As best seen in FIG. 2, audio-visual rail 120 further comprises top face 134.

Trigger guard side plate assembly 100 comprises side plate 102, forward trigger guard wall 112, and rear trigger guard wall 116. Side plate 102 has aperture 103 disposed at its interior face, forward edge 104, upper edge 105, bottom edge 106, notch 108, and rear edge 110. Aperture 103 is cooperatively aligned with hole 65 to receive a distal end of screw 67 when trigger guard side plate assembly 100 is assembled onto trigger guard cover assembly 60. Side plate 102 and lateral wall 68 have substantially a same shape and dimensions. Forward trigger guard wall 112 extends from upper edge 105 adjacent to front edge 104. Forward trigger guard wall 112 also has a substantial L-shape. Forward trigger guard wall 112 has edge 114. Rear trigger guard wall 116 extends from upper edge 105 adjacent to rear edge 110. Rear trigger guard wall 116 has edge 118.

Audio-visual recording assembly 140 comprises rear wall 142, front wall 144, and sidewall 146 with grip sections 148. Ridge 150 extends at the top of audio-visual recording assembly 140. Ridge 150 has protrusion 151 adjacent to front wall 144. As best seen in FIG. 2, elongated channel 152 extends from rear wall 142 to protrusion 151. Channel 158 extends from top to bottom of rear wall 142. Also at rear wall 142 is an electronic connection means cooperatively disposed to contact electrical contact 124 when present invention 10 is assembled. As an example, such an electronic connection means can be USB 160. USB 160 serves to download data and/or content of audio and/or video recordings and to recharge at least one rechargeable battery of present invention 10.

As an alternate embodiment, present invention 10 comprises means to enable wireless download of data and/or content of audio and/or video recordings and to wireless recharge of the at least one rechargeable battery of present invention 10. Specifically, audio-visual recording assembly 140 mounts onto mounting frame 20, whereby elongated channel 152 receives locking protrusions 130 until rear wall 142 reaches rear wall 122 as channel 158 receives protrusion 126 and USB 160 contacts electrical contact 124. Audio-visual recording assembly 140 further comprises lens 154 and microphones 156. Microphones 156 are preferably disposed at a top of front wall 144, and at each side of sidewall 146 adjacent to rear wall 142.

Audio-visual recording assembly 140 further comprises laser 162 and rail 170. Laser 162 emits a light to permit a user to adjust for needed elevation and/or windage, which allows the user to alight laser 162 with the sights of the weapon system. Laser 162 turns "on" and remains "on" while the predetermined force is placed upon exterior face 44 of pressure switch grip assembly 30. Rail 170 is mounted to a bottom portion of audio-visual recording assembly 140 as a bracket to provide a standard mounting platform for accessories and attachments. In a preferred embodiment, rail 170 may be a standard rail. In an alternate embodiment, rail 170 may be a picatinny rail. In another alternate embodiment, rail 170 may be a detachable from audio-visual recording assembly 140.

Figure 3:
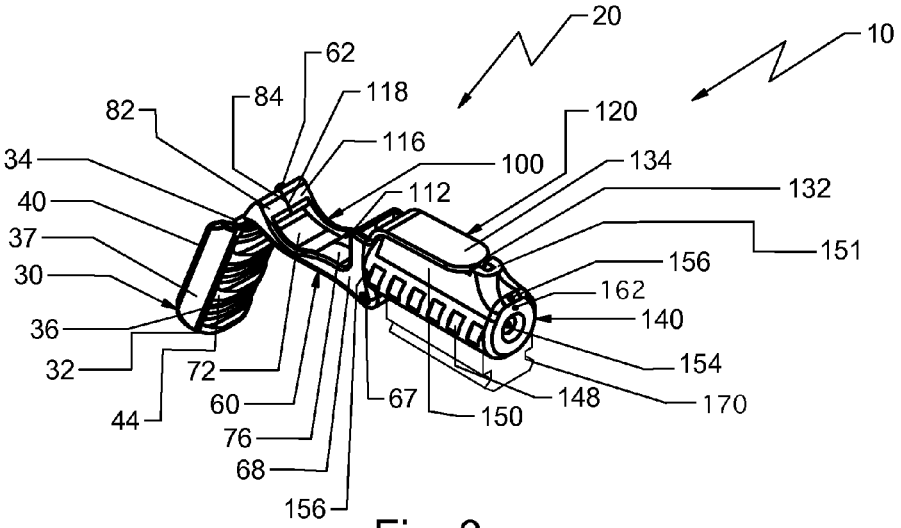
FIG. 3 is a first isometric view of the present invention assembled.
Figure 4:
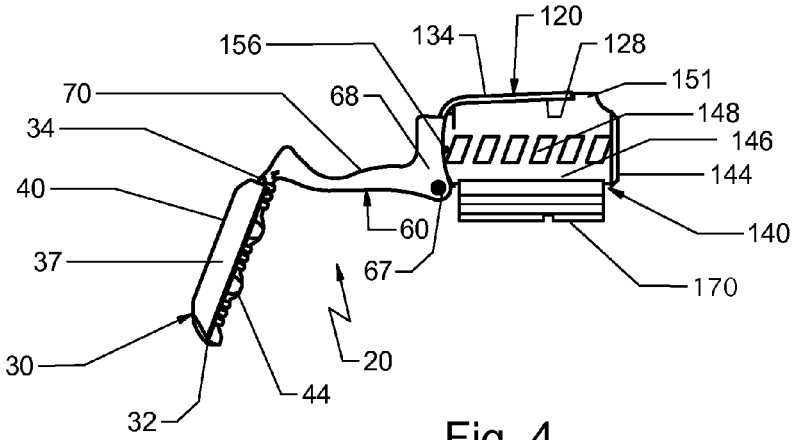
FIG. 4 is a side view of the present invention assembled.
Figure 5:
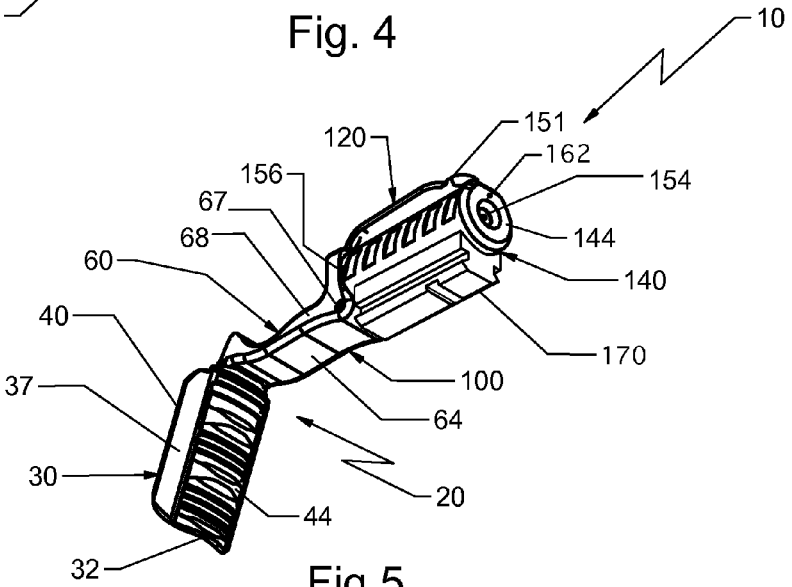
FIG. 5 is a second isometric view of the present invention assembled.

As seen in FIGS. 3, 4, and 5, audio-visual recording assembly 140 is mounted onto mounting frame 20.

Figure 6:
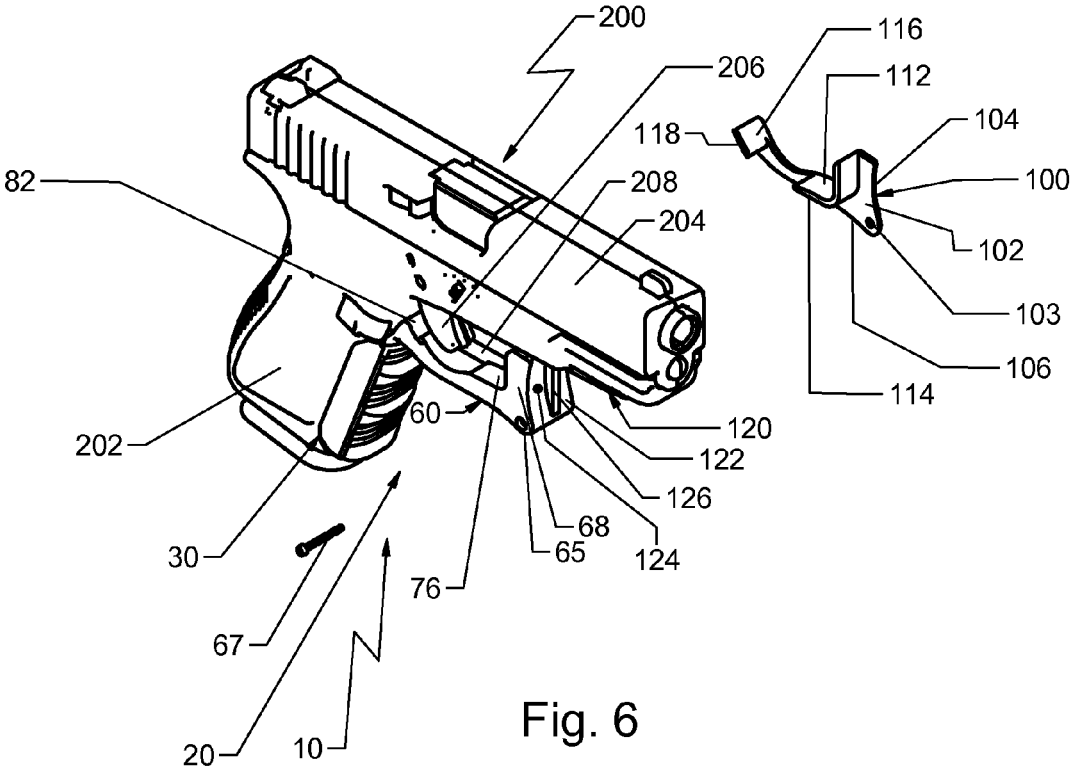
FIG. 6 is a first isometric view of the present invention, without the audio-visual recording assembly, being mounted onto a firearm.

As seen in FIG. 6, firearm 200 comprises grip 202, slide 204, trigger 206 and trigger guard 208. Firearm 200 may be any gun, being a barreled weapon that launches one or more projectiles often defined by the action of an explosive. To mount present invention 10 onto firearm 200, pressure switch grip assembly 30 is mounted to grip 202, trigger guard cover assembly 60 is mounted to trigger guard 208, and audio-visual rail 120 is biased against an underside of a firearm 200 frame. Sections of trigger guard 208 fill cavities 80 and 86.

Figure 7:
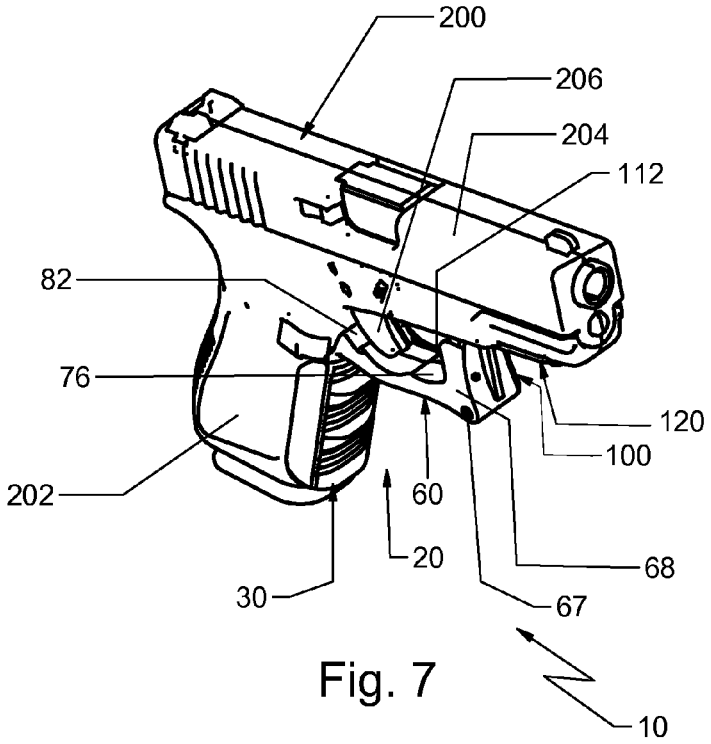
FIG. 7 is a second isometric view of the present invention, without the audio-visual recording assembly, mounted onto the firearm.

As seen in FIGS. 6 and 7, trigger guard side plate assembly 100 is mounted to trigger guard 208, opposite to lateral wall 68, whereby screw 67 passes through hole 65 and secures trigger guard side plate assembly 100 at aperture 103.

Figure 8:
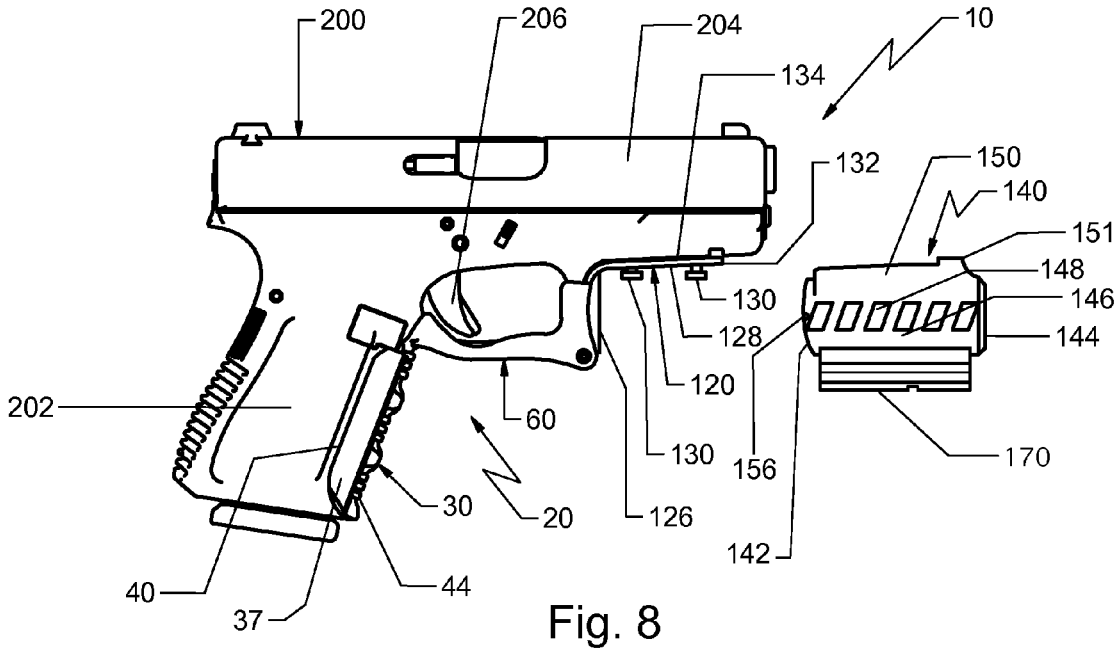
FIG. 8 is a side view of the audio-visual recording assembly being mounted onto an audio-visual rail of the present invention.
Figure 9:
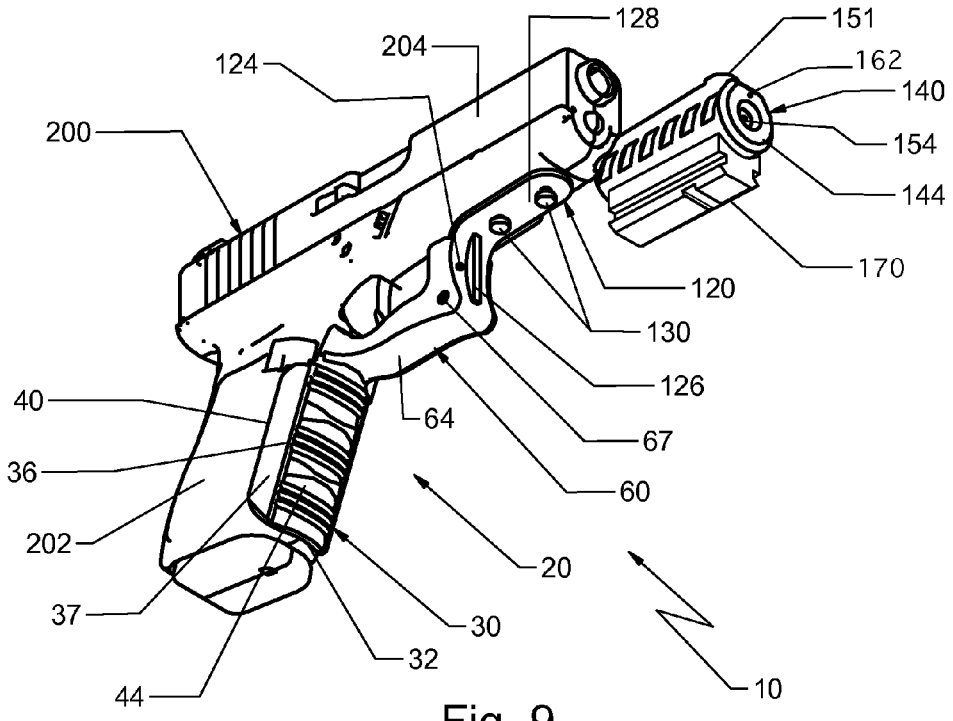
FIG. 9 is an isometric view of the audio-visual recording assembly being mounted onto the audio-visual rail of the present invention.

As seen in FIGS. 8 and 9, audio-visual recording assembly 140 mounts onto mounting frame 20, whereby elongated channel 152 receives locking protrusions 130 until rear wall 142 reaches rear wall 122 as channel 158 receives protrusion 126 and USB 160 contacts electrical contact 124.

Figure 10:
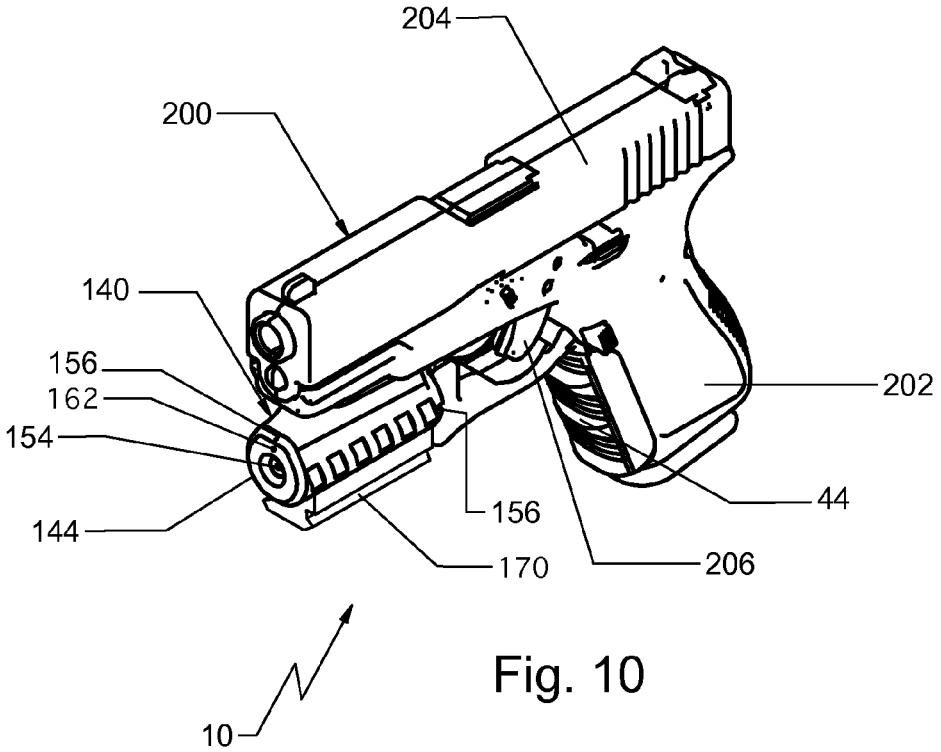
FIG. 10 a first isometric view of the present invention assembled and mounted onto the firearm.
Figure 11:
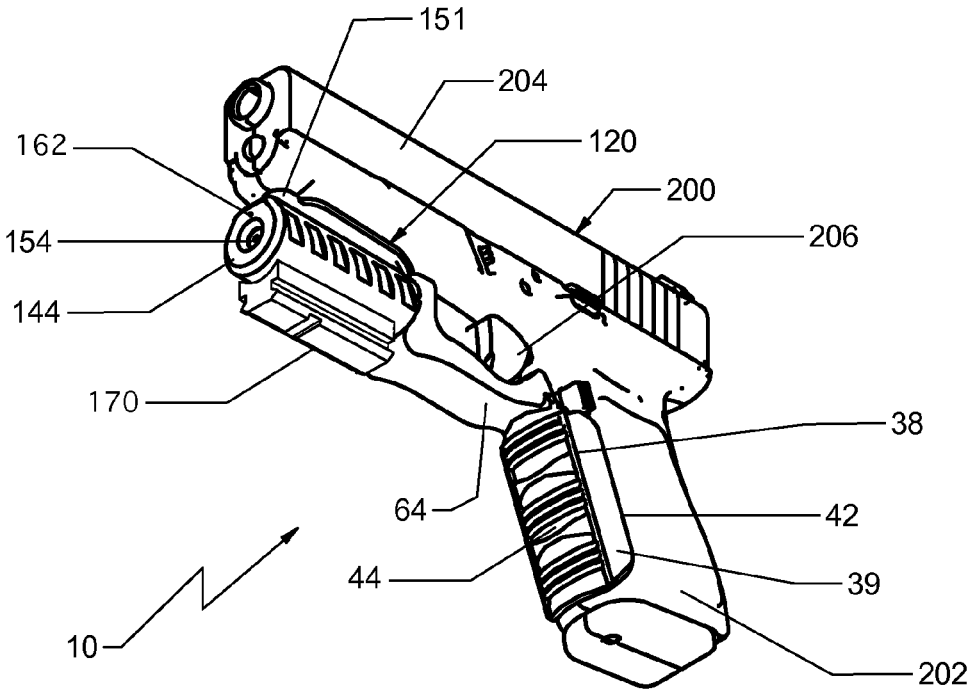
FIG. 11 a second isometric view of the present invention assembled and mounted onto the firearm.
Figure 12:
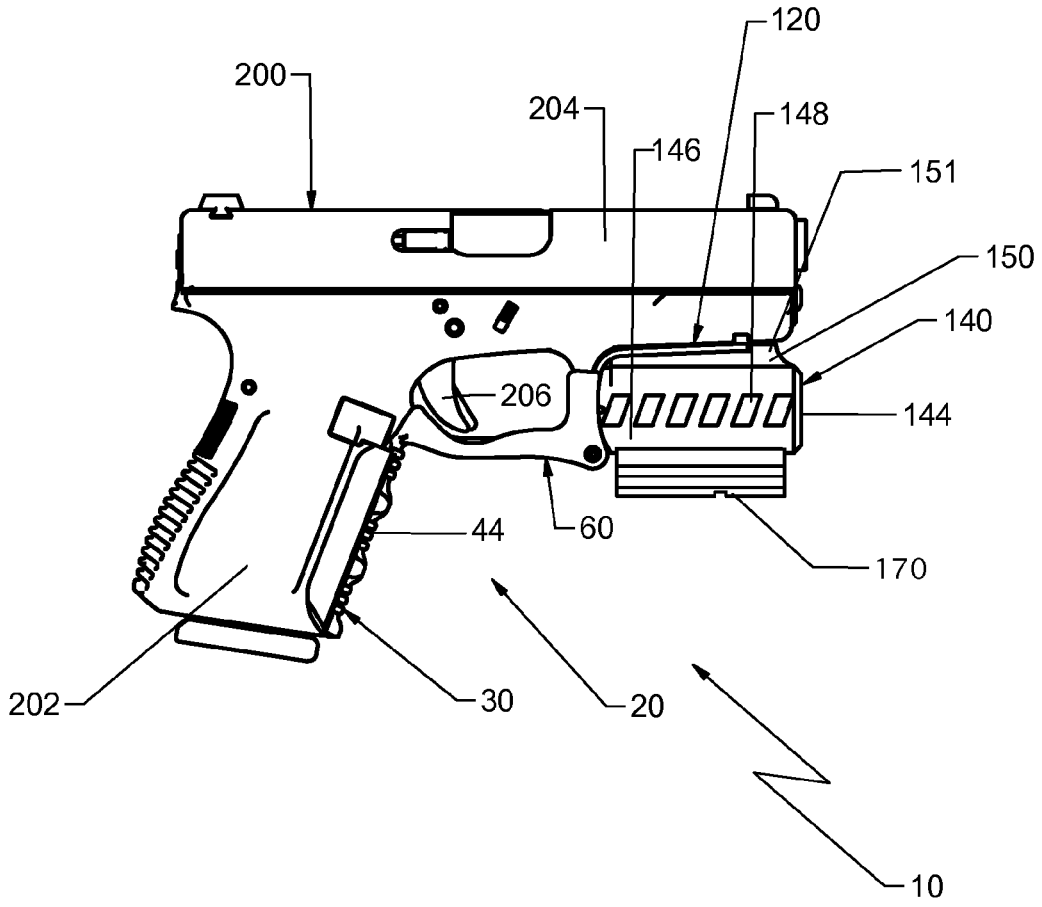
FIG. 12 a side view of the present invention assembled and mounted onto the firearm.

As seen in FIGS. 10, 11, and 12, present invention 10 is assembled and mounted onto firearm 200, whereby audio-visual recording assembly 140 is mounted below the barrel at a front of firearm 200 for optimal viewing angels.

In operation, pressure switch 46 is activated when the predetermined force is placed upon exterior face 44 while holding grip 202 as usual. Audio-visual recording assembly 140 comprises recording means to record high quality audio and/or video recordings of a target and/or surrounding area when pressure switch 46 is activated, even in low-light environments. Audio-visual recording assembly 140 continues recording for a predetermined time period even after pressure switch 46 has been released. The audio and/or video recordings serve as evidence for examination of firearm 200 aiming and/or shooting related incidents. In a preferred embodiment, audio-visual recording assembly 140 comprises electronic memory capacity for hours of recording, and data override capabilities so that most recent recordings are always available. In addition, audio-visual recording assembly 140 comprises the at least one rechargeable battery. Furthermore, audio-visual recording assembly 140 comprises date and time stamp capabilities on all recordings, and has quick detachment from mounting frame 20 while pressure switch grip assembly 30, trigger guard cover assembly 60, and audio-visual rail 120 remain on firearm 200. Furthermore, in a preferred embodiment, present invention 10 is manufactured of a water resistant, strong polymer and/or metal construction, or of materials having similar characteristics. Present invention 10 permits for constant reusability, and is small and compact to not interfere with any mechanics and/or operation of firearm 200.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm mounted video camera system, comprising:

A) a mounting frame comprising a pressure switch grip assembly, a trigger guard cover assembly, a trigger guard side plate assembly, and an audio-visual rail, said trigger guard cover assembly and said trigger guard side plate assembly mount onto a trigger guard of a firearm without obstructing a trigger of said firearm when firing said firearm, whereby said trigger guard side plate assembly is assembled onto said trigger guard cover assembly, said trigger guard cover assembly comprises a first forward trigger guard wall that has a substantial L-shape and said trigger guard side plate assembly comprises a second forward trigger guard wall that also has said substantial L-shape, said pressure switch grip assembly comprises a bottom edge, a top end, an exterior face, and an interior face, said exterior face comprises first and second lateral edges, extending at a predetermined angle from said first and second lateral edges are first and second lateral walls that have first and second edges respectively, and a pressure switch is cooperatively mounted at said interior face within said pressure switch grip assembly, said audio-visual rail extends from said trigger guard cover assembly to a front edge, said audio-visual rail comprises a rear wall having an electrical contact, and a top face; and B) an audio-visual recording assembly that comprises electronic memory capacity for recording, and data override capabilities so that most recent recordings are available, said audio-visual recording assembly comprises date and time stamp capabilities on recordings, and has quick detachment from said mounting frame while said pressure switch grip assembly, said trigger guard cover assembly, and said audio-visual rail remain on a firearm, said audio-visual recording assembly further comprises electronic connection means cooperatively disposed to contact said electrical contact, said electronic connection means serves to download data and/or content of audio and/or video recordings and to recharge at least one rechargeable battery or said electronic connection means enables wireless download of said data and content of said audio and/or video recordings and to wireless recharge said at least one rechargeable battery.

2. The firearm mounted video camera system set forth in claim 1, further characterized in that said audio-visual recording assembly mounts onto said audio-visual rail.

3. The firearm mounted video camera system set forth in claim 1, further characterized in that said audio-visual recording assembly comprises recording means to record said audio and/or video recordings of a target and/or surrounding area when said pressure switch of said pressure switch grip assembly is activated.

4. The firearm mounted video camera system set forth in claim 3, further characterized in that said pressure switch is activated when a predetermined force is placed upon said exterior face.

5. The firearm mounted video camera system set forth in claim 1, further characterized in that said pressure switch grip assembly mounts onto a grip of said firearm.

6. The firearm mounted video camera system set forth in claim 1, further characterized in that said audio-visual rail is biased against an underside of a firearm frame.

7. The firearm mounted video camera system set forth in claim 1, further characterized in that said audio-visual recording assembly comprises a laser.

8. The firearm mounted video camera system set forth in claim 1, further characterized in that said audio-visual recording assembly comprises a rail.

* * * * *